United States Patent [19]

Kojima

[11] Patent Number: 4,952,907

[45] Date of Patent: Aug. 28, 1990

[54] MOTOR DRIVEN BELL

[75] Inventor: Yoshikazu Kojima, Urawa, Japan

[73] Assignee: Kobishi Electric Co., Ltd., Tokyo, Japan

[21] Appl. No.: 437,077

[22] Filed: Nov. 14, 1989

[51] Int. Cl.[5] ..... G10K 1/00

[52] U.S. Cl. ..... 340/396; 340/392; 340/402

[58] Field of Search ..... 340/396, 392, 399, 400, 340/402; 116/152, 154, 155, 157, 158, 159, 163, 164, 167

[56] References Cited

U.S. PATENT DOCUMENTS

| | | | |
|---|---|---|---|
| 4,301,448 | 11/1981 | Ishii | 340/392 |
| 4,360,800 | 11/1982 | Ishii | 340/396 |
| 4,368,458 | 1/1983 | Ishii | 340/396 |
| 4,692,741 | 9/1987 | Shimoya et al. . | |

FOREIGN PATENT DOCUMENTS 63-1355 1/1988 Japan .

*Primary Examiner*—Joseph A. Orsino
*Assistant Examiner*—Brian R. Tumm
*Attorney, Agent, or Firm*—Darby & Darby

[57] ABSTRACT

In a motor driven bell, a pair of cam members are operatively connected to a drive shaft of a motor. One of the cam members acts directly on a leaf spring for moving a hammer attached to the leaf spring generally in parallel relation to the axis of rotation of the cam member to thereby allow the hammer to strike against an associated gong. The other cam member is disposed generally parallel to the cam member so that the leaf spring interposes therebetween. Therefore, the cam members define an amplitude of the leaf spring, whereby the hammer is able to strike against the gong without mis-striking.

6 Claims, 3 Drawing Sheets

MOTOR DRIVEN BELL

BACKGROUND OF THE INVENTION

The present invention relates to motor driven bells operatively including a gong and motor driven hammer.

U.S. Pat. Nos. 4,692,741 and 4,368,458 disclose prior art motor driven bells incorporating a gong and motor driven hammer. FIGS. 1 and 2 show the prior art bell of U.S. Pat. No. 4,368,458. Such a bell comprises a cam member 20 connected to a driving shaft 22 of a motor 24. The cam member 20 acts on a leaf spring 26 for impelling a hammer 28 which is attached to the leaf spring 26, thereby causing the hammer to strike against a gong 30. With such a bell, however, the following problems exist:

1. Fluctuations in the electrical power delivered to the bell results in variation in both the frequency and amplitude of the displacement of the leaf spring.
2. Over time, the physical characteristics and hence the natural frequency of the leaf spring changes.
3. As a result of 1 and 2 above, a mismatch is likely to develop between the naural frequency of the leaf spring and the frequency at which its associated hammer are impelled by the cam member.

In such a case, the leaf spring and impelling cam member may operate antagonistically with each other resulting in diminished striking power of the hammer against the gong, and damping of the strength of the striking contact between the hammer and the gong.

4. In bells of the prior art design, the incorporated leaf spring is prone to mechanical deterioration which further aggravates the above described problems.

SUMMARY OF THE INVENTION

It is therefore an object of the present invention to provide a motor driven bell which can deliver continuous, high quality sound output over an extended service life.

It is another object of the present invention to provide a motor driven bell including a leaf spring with improved mechanical properties.

According to one aspect of the present invention, a motor driven bell comprises a gong means having an inner wall, a base mounted within the gong means, and a motor mounted on the base within the gong means, and having a rotatable driving shaft extending toward the inner wall of the gong means.

The bell further comprises a hammer means. The hammer means comprises a hammer element for stiking against the inner wall of the gong means, and a leaf spring means fixedly secured at one end thereof to the base by which means the hammer element is fixedly secured on the base via the leaf spring.

A pair of cam members are operatively and fixedly connected to the driving shaft of the motor for rotation thereabout in concert with rotation of the shaft. Each cam member has a cam surface, the cam surface of each member of the pair of cam members opposing and in an approximately parallel relationship with that of the other. The cam surfaces deviate to some extent from a perpendicular relation ship with the longitudinal axis of the driving shaft and a portion of the leaf spring is interposed between this pair of opposing cam surfaces, whereby rotational motion of the shaft is translated into an oscillatory motion of the interposed leaf spring and hence the hammer element, the amplitude of said oscillatory motion being proportional to the extent that the opposing cam surfaces deviate from a perpendicular relationship with the longitudinal axis of the shaft.

DETAILED DESCRIPTION OF THE PREFERRED EMBODIMENT

With reference to the accompanying drawings, a preferred embodiment of the present invention will be described hereinafter.

Figure 1:
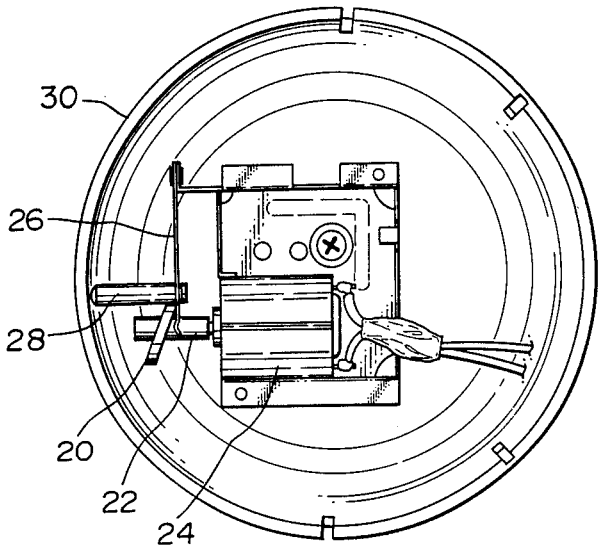
FIG. 1 (PRIOR ART)
FIG. 1 is a rear view of a prior art motor driven bell.
Figure 2:
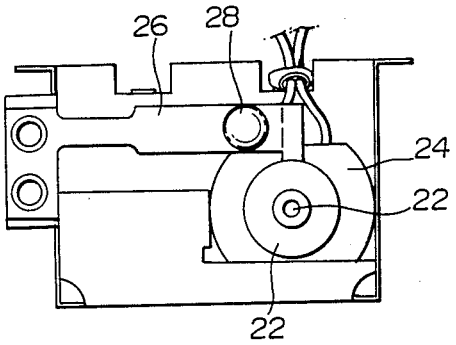
FIG. 2 (PRIOR ART)
FIG. 2 is a side view showing principal parts within the bell in FIG. 1.
Figure 3:
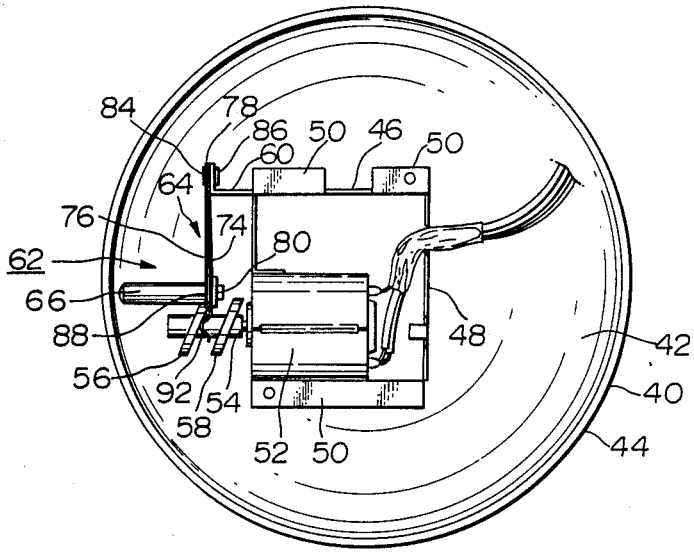
FIG. 3 is a rear view of a motor driven bell according to an embodiment of the present invention.

FIG. 3 depicts a motor driven bell in accordance with the present invention, comprising a gong 40, of an inverted cup-type, having an inner wall 42 of which the central portion is generally planar. The inner wall 42 of the gong 40 has a curvature in a radial direction, increasing gradually from the central portion to the peripheral portion thereof, so that the peripheral portion is disposed generally perpendicularly to the central portion. The gong 40 has a rear rim 44 in parallel relation with the central portion of the inner wall 42.

A base 46 is mounted to the central portion of the inner wall 42 of the gong 40. The base 46 is of a generally rectangular framework and has a rectangular peripheral wall 48 of a uniform height which projects perpendicularly from the central portion of the inner wall 42. The base 46 has rear brim portions 50 extending from the rearward edge of the peripheral wall 48 towards the peripheral portion of the inner wall 42, the rear brim portions 50 being parallel to the central portion of the inner wall 42. To the rear brim portions 50, a planar circular lid (not shown) is fastened in order to protect enclosures (which will be described later) disposed in the gong 40 from being exposed to external conditions.

A DC motor 52 is disposed within and secured to the rectangular framework of the base 46 in such a fashion that the driving shaft 54 of the motor 52 is parallel to the central portion of the inner wall 42 of the gong 40 and the driving shaft 54 is disposed in a line generally perpendicular to the peripheral portion of the inner wall 42.

A pair of plate-like cam members 56 and 58 of approximately the same shape are operatively and fixedly connected to the driving shaft 54 for rotation thereabout in an approximatley parallel relation to each other. The cam members 56 and 58 have an elliptical shape such that when viewed in a plane perpendicular to the longitudinal axis of the driving shaft 54, they appear circular. The cam members 56 and 58 are mounted at the centers thereof on the driving shaft 54 so as to lie in approximately parallel planes which deviate from a perpendicular position with respect to the driving shaft 54 as shown in FIG. 3. Due to the approximately parallel relationship of the cam members 56 and 58, their motion remains in phase.

An L-shaped connecting plate 60 is fixedly secured at the longer side to the peripheral wall 48 of the base 46 in order to support a hammer means 62. The longer side of the connecting plate 60 is disposed in a plane perpendicular to the central portion of the inner wall 42 of the gong 40 and parallel to the driving shaft 54 of the motor 52. The shorter side of the connecting plate 60 faces the peripheral portion of the inner surface 42 of the gong 40.

The above-mentioned hammer means 62, which is mounted on the connecting plate 60, comprises a link means or leaf spring means 64 and a hammer element 66 connected to the shorter side of the connecting plate 60 via the leaf spring means 64.

Figure 5:
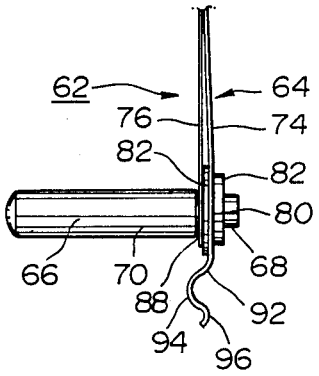
FIG. 5 is an enlarged rear view showing a hammer and leaf springs of the bell shown in FIG. 3.
Figure 6:
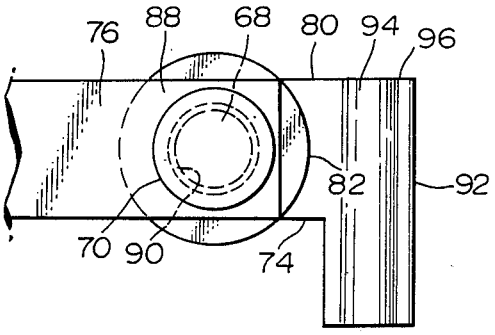
FIG. 6 is an enlarged side view showing the hammer and leaf springs of the bell shown in FIG. 3.

The hammer element 66 is of a round bar shape and is fixedly secured at its proximal end to the leaf spring means 64 so that the axis of the hammer element 66 is disposed perpendicular to the peripheral portion of the inner wall 42 of the gong 40 and the distal end of the hammer element 66 is capable of striking against the peripheral portion of the inner wall 42. As best shown in FIGS. 5 and 6, the proximal end 68 of the hammer element 66 has a smaller diameter than the other portion 70.

Figure 4:
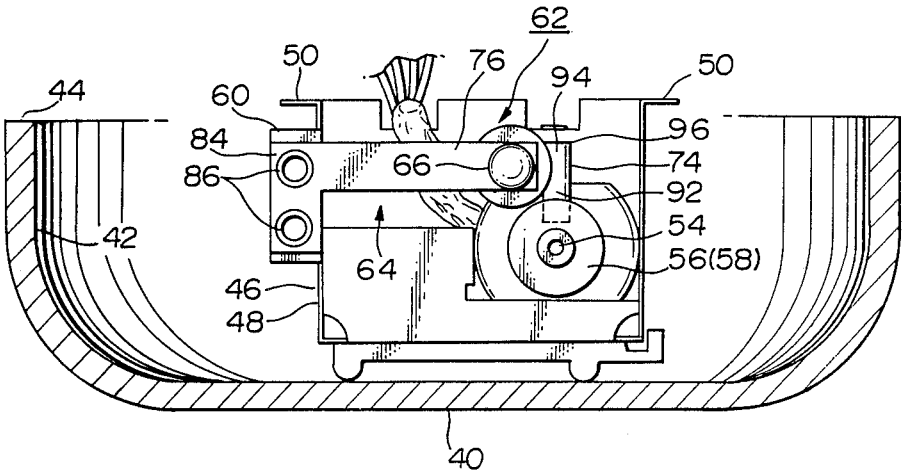
FIG. 4 is a side view showing principal parts of the bell shown in FIG. 3.

The leaf spring means 64 comprises a generally rectangular main leaf spring 74 and a generally rectangular support leaf spring 76 layered on the main leaf spring 74. As best shown in FIG. 4, the main and support leaf springs 74 and 76 extend parallel to the central portion of the inner wall 42 of the gong 40, and above the cam members 56 and 58. The support leaf spring 76 faces the peripheral portion of the inner surface 42 of the gong 40. The main leaf spring 74 extends to the space between the cam members 56 and 58. As shown in FIG. 3, the main leaf spring 74 has a first end 78 fixedly secured to the shorter side of the connecting plate 60. As shown in FIG. 5, a second end 80 of the main leaf spring 74 is fixedly secured to the proximal end namely small diameter portion 68 of the hammer element 66. A pair of parallel connecting rings 82 fixedly fit around the small diameter portion 68 with the second end 80 held tightly between them.

The support leaf spring 76 has a thickness less than that of the main leaf spring 74 and a mechanical strength also less than that of the main leaf spring 74. The support leaf spring 76 has a first end 84 fixedly secured to the shorter side of the connecting plate 60 together with first end 78 of the main leaf spring 74 by a pair of rivets 86 as shown in FIGS. 3 and 4. As shown in FIG. 5, a second end 88 of the support leaf spring 76 is held in contact engagement with the hammer element 66, but is not fixedly secured to the hammer element 66.

As shown in FIG. 6, the support leaf spring 76 has a circular hole 90 penetrating through the second end 88 thereof. The hole 90 is greater than the small diameter portion 68 of the hammer element 66 in diameter. The small diameter portion 68 is slidably inserted through the hole 90 and is disposed concentric to the hole 90 when the spring 76 is in a static condition. As shown in FIG. 5, the second end 88 of the leaf spring 76 with the hole 90 is able to slide along an axis of the hammer element 66 within a space formed between the other portion of the hammer element, namely large diameter portion 70 and the connecting ring 82 nearer to the large diameter portion 70 than the other.

Therefore, while the support leaf spring 76 is not fixedly secured to the hammer element 66, the support leaf spring 76 can apply a spring force thereof cooperating with that of the main leaf spring 74. Since the second end 88 of the leaf spring 76 with the hole 90 is able to slide along an axis of the hammer element 66, the main and support leaf spring can vibrate as different vibrational systems independent from each other. Accordingly, the main and support leaf springs 74 and 76 are not substantially subjected to each other's spring action. Furthermore, since the hole 90 is greater than the small diameter portion 68 of the hammer element 66, the support leaf spring can move in the lengthwise direction thereof. Accordingly, the main and support leaf springs 74 and 76 are not affected by each other's transformations in the lengthwise direction thereof.

The main leaf spring 74 further has an extension piece 92 extending downwardly as viewed in FIG. 4 from the second end 80 thereof into the space between the facing cam surfaces of the cam members 56 and 58 so that the extension piece 92 is able to contact the cam surfaces.

As shown in FIGS. 3 and 5, the extension piece 92 has a first contact portion 94 nearer to the hammer element 66 for receiving the urging force from the cam member 56. The first contact portion 94 has a semi-circular profile convex toward the cam member 56. The extension piece 92 has a second contact portion 96 remote from the hammer element 66 for receiving the urging force from the cam member 58. The second contact portion 96 has a semi-circular profile convex toward the cam member 58. By virtue of the first and second contact portions 94 and 96, the extension piece 92 is effectively prevented from receiving damage or abrasion caused by the contact with the cam members 56 and 58.

The motor 52 is connected to a direct-current electric power source (not shown) which is installed outside of the gong 40.

In operation, the motor 52 is first driven through the power source to rotate the cam members 56 and 58 in a clockwise direction (FIG. 4) so that the cam member 56 remote from the body of the motor 52 urges the leaf spring means 64 with the hammer element 66 away from the peripheral portion of the gong 40 through the extension piece 92 of the main leaf spring 74, and then the cam member 58 near the body of the motor 50 urges the leaf spring means 64 towards the peripheral portion of the gong 40. As a result, the cam members 56 and 58 alternately act on the leaf spring means 64, so that the gong 40 is struck once by the hammer element 66 during one revolution of the cam members 56 and 58. During the operation of the bell, the hammer element 66 moves in parallel relation to the axis of rotation of the cam members 56 and 58.

In the operation, the support leaf spring 76, supporting the spring force of the main leaf spring 74, moves in the same direction as the movement of the main leaf spring 74. However, the main and supporting leaf springs 74 and 76 move as vibrating systems substantially independent from each other since the support leaf spring 76 is not fixedly secured to the hammer element 66.

With the above construction of the motor driven bell, the cam members 56 and 58 alternately act on the leaf spring means 64 interposed therebetween so as to define an amplitude and the frequency of the leaf spring means 64. Thus, even if there is a frequency-difference between the leaf spring means 64 and the motor 52 or even if the amplitude of the leaf spring means 64 becomes higher than a prescribed value, the hammer element 66 mounted on the leaf spring means 64 is compulsorily and absolutely urged towards and away from the peripheral portion of the gong 40 so that the hammer element 66 strikes invariably once against the gong 40 during one revolution of the motor 52. Since the hammer element 66 stikes against the gong 40 without misstriking, sound is emitted from the bell continuously without interruption.

As described above, the second end 88 of the support leaf spring 76 is not fixedly secured to the hammer element 66 and moves relative to the main leaf spring 74. Accordingly, while the support leaf spring 76 supports the spring action of the main leaf spring 74, the leaf springs 74 and 76 are not substantially subjected to each other's respective spring forces and are not affected by each other's distortions, natural frequencies and amplitudes. Therefore, it is possible for the leaf spring means 64 to have a mechanical strength greater than that in a conventional motor driven bell.

The spring force is applied to the hammer element from the two leaf springs 74 and 76. In order to apply a certain spring force to the hammer element, the thickness of each of the leaf springs 74 and 76 can be thinner than the leaf spring in a conventional motor driven bell. Consequently, the strain values on the front and rear surfaces of each of the leaf springs 74 and 76 are not so different from each other in the operation of the bell. Therefore, the leaf spring means 64 have a relatively long service life.

In the above construction, it is preferable that the distance between the cam members 56 and 58 is defined in light of the configuration of the extension piece 92, spring constant of the spring means 64, the revolution of the motor shaft 54, and the like so that for instance when the hammer element 66 strikes against the gong 40, the extension piece 92 does not touch the cam member 56. Therefore, wear and energy loss caused by the friction between the extension piece 92 and the cam member 56 do not occur. Furthermore, the defined orientation of the cam members 56 and 58 allows a constant striking frequency.

What is claimed is:

1. A motor driven bell comprising:

(a) a gong means having an inner wall;

(b) a base mounted within said gong means;

(c) a motor mounted on said base within said gong means, the motor having a rotatable driving shaft extending toward said inner wall of the gong means;

(d) a pair of cam members operatively connected to said driving shaft of said motor for rotation about the axis of said shaft, each of said cam members having a cam surface, said cam surfaces facing each other in a spaced relation and lying in approximately parallel planes which deviate from a perpendicular position with respect to said driving shaft; and (e) a hammer means comprising (i) a link means connected at one end thereof to said base, the link means extending into the space between the cam surfaces for moving toward and away from the inner wall of said gong means; and (ii) a hammer element for striking against the inner wall of said gong means, the hammer element being connected to the link means whereby the hammer element moves toward and away from said inner wall of said gong means.

2. A bell according to claim 1, in which said link means is a leaf spring means fixedly connected at one end thereof to said base.

3. A bell according to claim 2, in which said leaf spring means is disposed generally perpendicular to the axis of said driving shaft.

4. A bell according to claim 2, in which said leaf spring means comprises:

a main leaf spring having an end fixedly secured to said base, and an end fixedly secured to the hammer element; and at least one support leaf spring having a spring force for supporting a spring force of the main leaf spring, the support leaf spring having a first end fixedly secured to one of said base and hammer element, and a second end connected to the other of said base and hammer element.

5. A bell according to claim 4, wherein said second end of said support leaf spring is allowed to move substantially independently from said main leaf spring.

6. A bell according to claim 5, in which said main leaf spring has a mechanical strength greater than that of said support leaf spring.

* * * * *